US010364972B1

(12) United States Patent
Breedlove, Sr. et al.

(10) Patent No.: US 10,364,972 B1
(45) Date of Patent: Jul. 30, 2019

(54) LANDSCAPE LIGHTING JUNCTION HUB

(71) Applicant: Volt, LLC, Tampa, FL (US)

(72) Inventors: Michael Grant Breedlove, Sr., Odessa, FL (US); Jesse Daniel Harper, Wesley Chapel, FL (US)

(73) Assignee: Volt, LLC, Tampa, FL (US)

( * ) Notice: Subject to any disclaimer, the term of this patent is extended or adjusted under 35 U.S.C. 154(b) by 13 days.

(21) Appl. No.: 15/718,719

(22) Filed: Sep. 28, 2017

Related U.S. Application Data

(60) Provisional application No. 62/401,475, filed on Sep. 29, 2016, provisional application No. 62/537,710, filed on Jul. 27, 2017.

(51) Int. Cl.

| | |
|---|---|
| ***F21V 21/00*** | (2006.01) |
| ***F21V 23/00*** | (2015.01) |
| ***F21V 15/01*** | (2006.01) |
| ***F21S 8/08*** | (2006.01) |
| *F21V 21/08* | (2006.01) |

(52) U.S. Cl.
CPC ..... *F21V 23/002* (2013.01); *F21S 8/081* (2013.01); *F21V 15/01* (2013.01); *F21V 21/0824* (2013.01)

(58) Field of Classification Search
CPC ..... F21S 8/081; F21S 21/0824
USPC ..... 362/227, 145, 163.1, 362
See application file for complete search history.

(56) References Cited

U.S. PATENT DOCUMENTS

| | | | | |
|---|---|---|---|---|
| 5,243,508 | A * | 9/1993 | Ewing | F21S 2/005 362/431 |
| 5,414,607 | A | 5/1995 | Harris et al. | |
| 6,337,792 | B1 | 1/2002 | George | |
| 7,044,776 | B2 | 5/2006 | King, Jr. et al. | |
| 7,387,409 | B1 * | 6/2008 | Beadle | F21S 8/081 362/153 |
| 7,677,932 | B2 | 3/2010 | King, Jr. et al. | |
| 7,699,481 | B2 | 4/2010 | Mullen | |
| 7,726,849 | B2 * | 6/2010 | Haddad | F21S 8/088 362/309 |
| 7,988,503 | B2 | 8/2011 | King, Jr. et al. | |
| 8,006,375 | B2 | 8/2011 | Mullen | |
| 2014/0168905 | A1 * | 6/2014 | Ko | H01R 9/2425 361/728 |
| 2015/0308630 | A1 * | 10/2015 | Bendtsen | F21K 9/64 362/235 |

FOREIGN PATENT DOCUMENTS

| | | |
|---|---|---|
| CN | 201944618 U | 8/2011 |

OTHER PUBLICATIONS

"WAGO 222—The flexible all-rounder" video, uploaded Sep. 9, 2013 at https://www.youtube.com/watch?v=-PfN_wwkujQ.
Co-pending U.S. Appl. No. 15/796,057, filed Oct. 27, 2017, all enclosed pages cited.

* cited by examiner

*Primary Examiner* — Laura K Tso

(74) *Attorney, Agent, or Firm* — Nelson Mullins Riley & Scarborough, LLP

(57) ABSTRACT

A junction hub may include a fixture body include a top portion and a bottom portion. The junction hub may further include a connector device for operably coupling a mounting structure to the fixture body. The junction hub may even further include a terminal block disposed in the fixture body for facilitating the connection of a power source to at least one lighting fixture.

20 Claims, 16 Drawing Sheets

LANDSCAPE LIGHTING JUNCTION HUB

PRIORITY CLAIM

This application is based upon and claims priority to U.S. application Ser. No. 62/401,475, filed Sep. 29, 2016, and U.S. application Ser. No. 62/537,710, filed Jul. 27, 2017. Both of the aforementioned applications are incorporated fully herein by reference in their entirety for all purposes.

FIELD OF THE INVENTION

The present invention relates generally to the art of landscape lighting systems, and more particularly, to a junction hub for a landscape lighting system that enables the connection of devices of the landscape lighting system.

BACKGROUND

Outdoor landscape lighting systems are commonly used in both commercial and residential settings for the illumination of structures, walkways, trees, shrubbery, etc. In an outdoor landscape lighting system, users may find it difficult and time consuming to install multiple lighting fixtures. For example, the user may spend considerable time and employ various tools to connect each lighting fixture in parallel with a power source of the landscape lighting system. Moreover, if a problem arises in the landscape lighting system, the user may have difficulty troubleshooting where the problem exists. Even further, if a lighting fixture has to be repaired or removed or if an additional lighting fixture is added to the landscape lighting system, the user may find it difficult and time consuming to do so.

SUMMARY

Example embodiments of the present invention recognize and address considerations of prior art constructions and methods.

One aspect of the present invention provides an outdoor landscape lighting junction hub. The junction hub comprises a fixture body having a top portion and a bottom portion removably connectable together to define an interior. A connector device for operably coupling a mounting structure to the fixture body is also provided. A terminal block is disposed in the interior of the fixture body for facilitating the connection of a power source to at least one lighting fixture. For example, the terminal block may be connected to the top portion of the fixture body.

In some exemplary embodiments, the bottom portion of the fixture body defines at least one opening for receiving wires of the power source or the at least one lighting fixture. A respective cap may be situated in the at least one opening to seal the opening when not in use.

In some exemplary embodiments, the connector device may be in the form of a depending boss defining exterior threads thereon integrally extending from the bottom portion of the fixture body. The depending boss may be hollow to allow passage of wires therethrough.

In some exemplary embodiments, the terminal block may comprise a first polarity terminal portion and a separate second polarity terminal portion. In some exemplary embodiments, the first polarity terminal portion may be disposed on a first side of a partition wall and the second polarity terminal portion may be disposed on a second side of the partition wall. The partition wall in some exemplary embodiments may comprise at least one opening receiving a fastener that operably couples the first polarity terminal portion to the second polarity terminal portion.

In some exemplary embodiments, the top portion may define an opening having internal threads for connecting a lighting fixture support post. Embodiments are contemplated in which the top portion and the bottom portion are slidably connected. According to other embodiments, the top portion and the bottom portion may be threadably connected.

Preferably, the terminal block may comprise a plurality of ports and a respective locking mechanism corresponds to each of the ports to releasably retain a respective wire therein.

Another aspect of the present invention provides an outdoor landscape lighting system comprising a power source and at least one lighting fixture. At least one junction hub is also provided having a fixture body comprising a top portion and a bottom portion defining an interior. A mounting structure is coupled to the fixture body. A terminal block is disposed in the interior of the fixture body for facilitating the connection of the power source to the least one lighting fixture.

Those skilled in the art will appreciate the scope of the present invention and realize additional aspects thereof after reading the following detailed description of example embodiments in association with the accompanying drawing figures.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

DETAILED DESCRIPTION OF THE PREFERRED EMBODIMENTS

Figure 1:
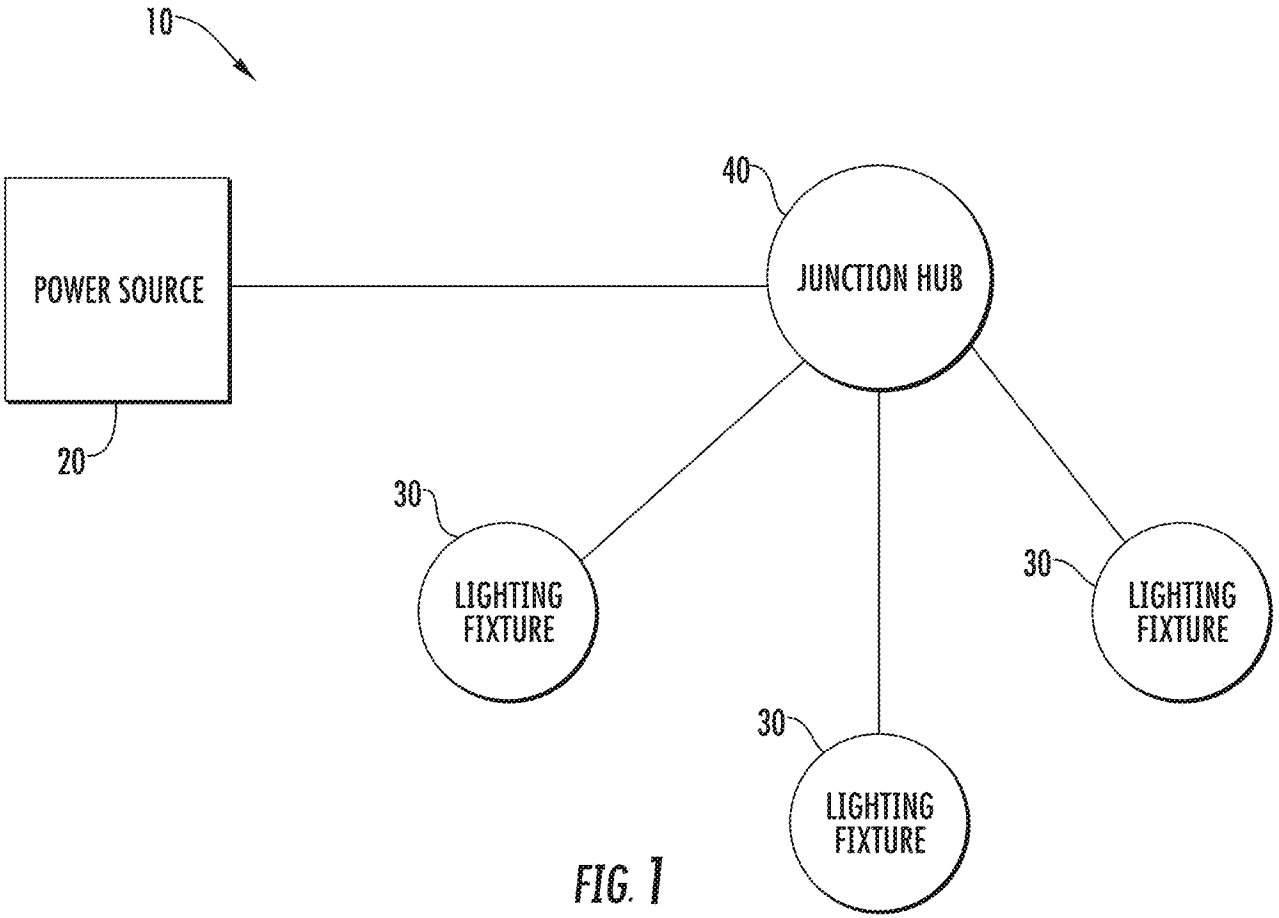
FIG. 1 is a diagrammatic representation of an outdoor lighting system in accordance with an example embodiment.

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Users may prefer a landscape lighting system that is easy and quick to setup and install, and if a problem arises in the landscape lighting system, that is easy to troubleshoot and repair. Some example embodiments described herein provide a landscape lighting system having a junction hub. The junction hub provides a junction for the easy connection of a power source and one or more lighting fixtures of the landscape lighting system. Further, the junction hub enables the efficient replacement or addition of lighting fixtures to the landscape lighting system. Moreover, some embodiments may provide a convenient location for testing or troubleshooting problems arising in the landscape lighting system.

FIG. 1 illustrates an exemplary outdoor landscape lighting system according to some example embodiments. As shown in FIG. 1, the outdoor landscape lighting system 10 may include a power source 20, at least one lighting fixture 30, and at least one junction hub 40. It should be understood that, in accordance with other example embodiments, the landscape lighting system 10 may include more than one junction hub 40 connected to a single power source 20, with multiple lighting fixtures 30 being connected at one of the junction hubs 40. In accordance with other example embodiments, one lighting fixture may be integral with the junction hub with one or more additional lighting fixtures also connected to the junction hub, as further described below.

The lighting fixtures 30 may be placed where desired throughout an outdoor landscape and connected to the power source 20 via the junction hub 40. Accordingly, when using a junction hub 40 as part of the landscape lighting system 10, the installation time associated with installing the components of the landscape lighting system 10 may be reduced.

The power source 20 of the landscape lighting system 10 may comprise a transformer. The transformer may plug into a standard AC outlet, such as a 120 VAC outlet typically used in North America. Moreover, the transformer may have AC outputs between 8V-15V. The transformer may also have control circuitry and be used as part of a control panel for collectively controlling the lighting fixtures 30 throughout the outdoor landscape. For example, the control panel can include a timer that turns all of the lights on or off at specified intervals, or a control for brightening or dimming the lighting fixtures 30 in the landscape lighting system 10. One skilled in the art will appreciate that other means for powering the lighting fixtures 30 are within the scope of the invention. For example, the power source 20 may be solar or battery powered or the like.

As shown, at least one lighting fixture 30 may be connected to the junction hub 40 by wiring. FIG. 1, for example, illustrates three lighting fixtures 30 in the landscape lighting system 10; however, in accordance with various embodiments, the landscape lighting system 10 may include more or less than three lighting fixtures 30. Each lighting fixture 30 may include a lighting source such as an incandescent, halogen, LED, and/or the like lighting source. Moreover, each lighting fixture 30 may also include a control board. For example, the control board may contain power supply circuitry that converts the AC voltage received from the power source 20 to a DC voltage suitable for the respective lighting fixture 30.

Figure 4:
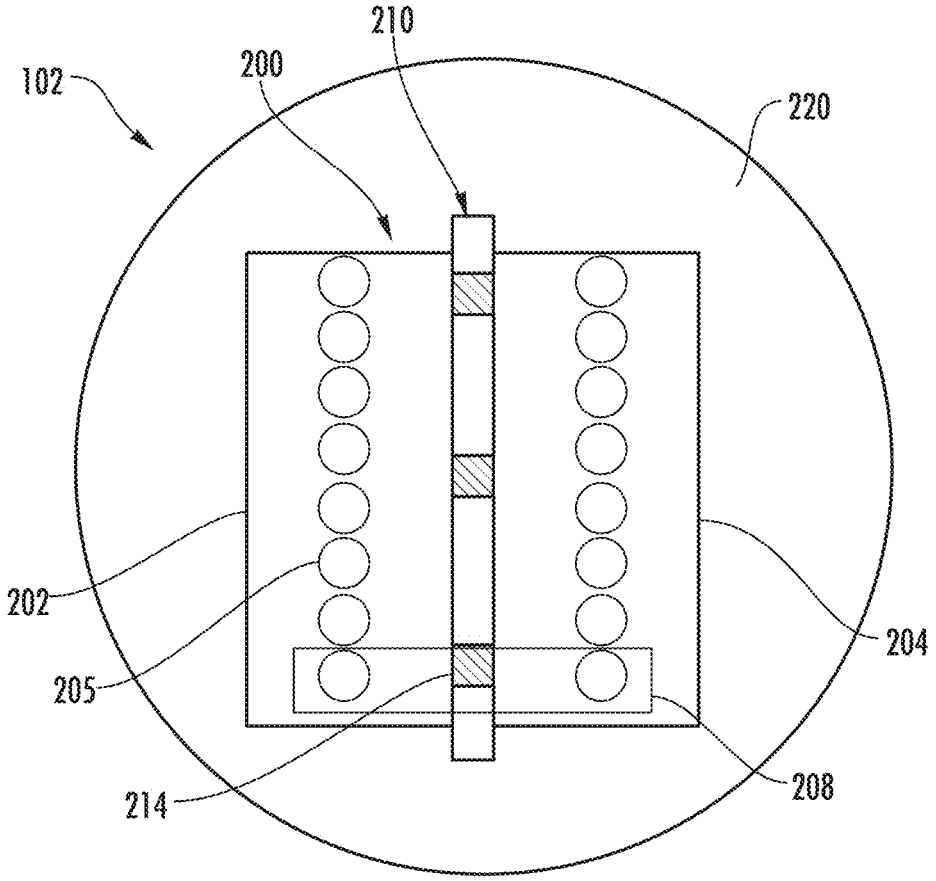
FIG. 4 is a diagrammatic representation of an interior of a top portion of a junction hub in accordance with an example embodiment.
Figure 5:
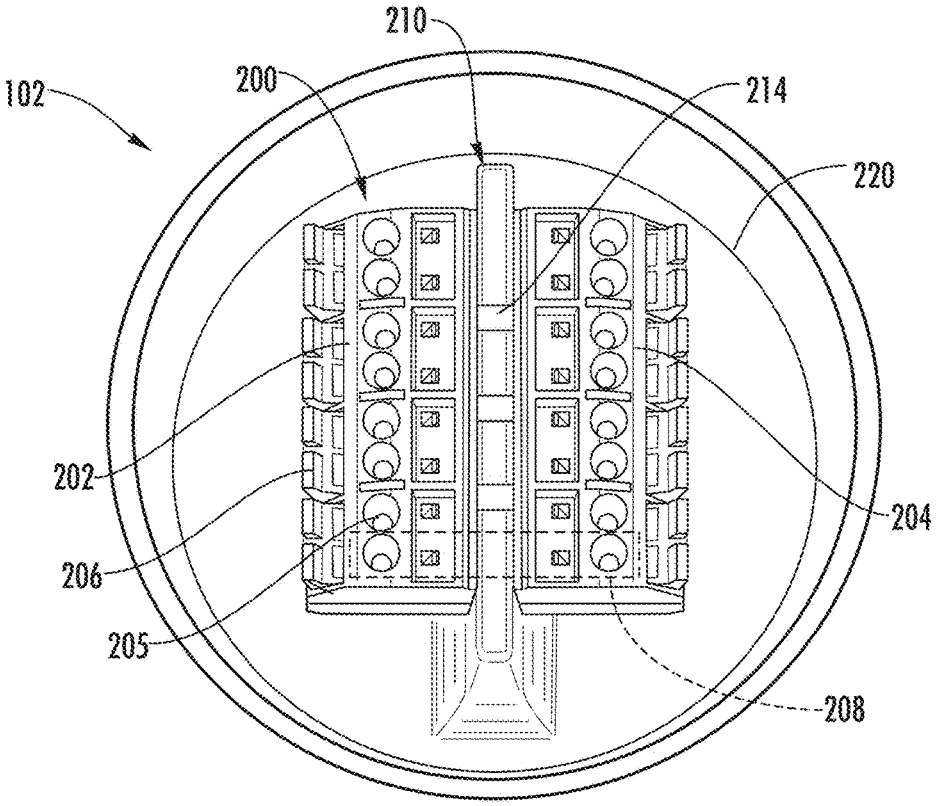
FIG. 5 is a perspective view of an interior of a top portion of a junction hub in accordance with an example embodiment.

Referring now to FIGS. 4-5, the junction hub 40 may include a terminal block 200 that serves as a junction by which the user may connect one or more of the lighting fixtures 30 to the power source 20. Accordingly, the junction hub 40 enables a quick and efficient connection of the lighting fixtures 30 to the power source 20.

Figure 2:
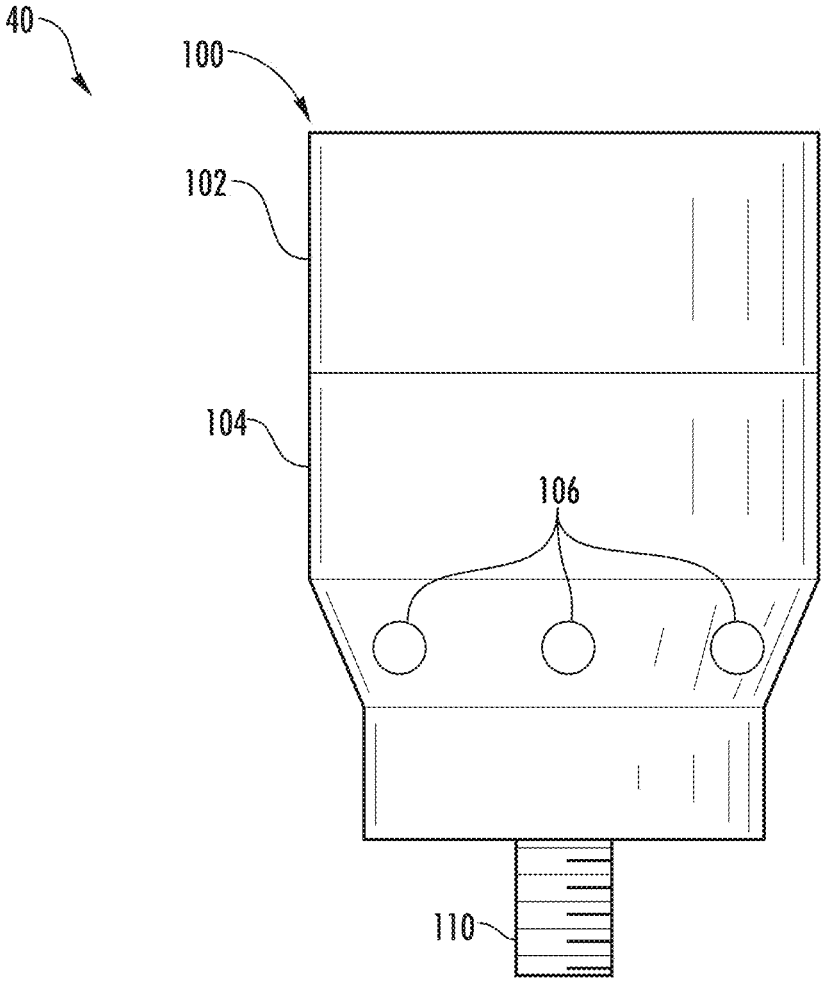
FIG. 2 is a diagrammatic representation of a junction hub in accordance with an example embodiment.
Figure 3:
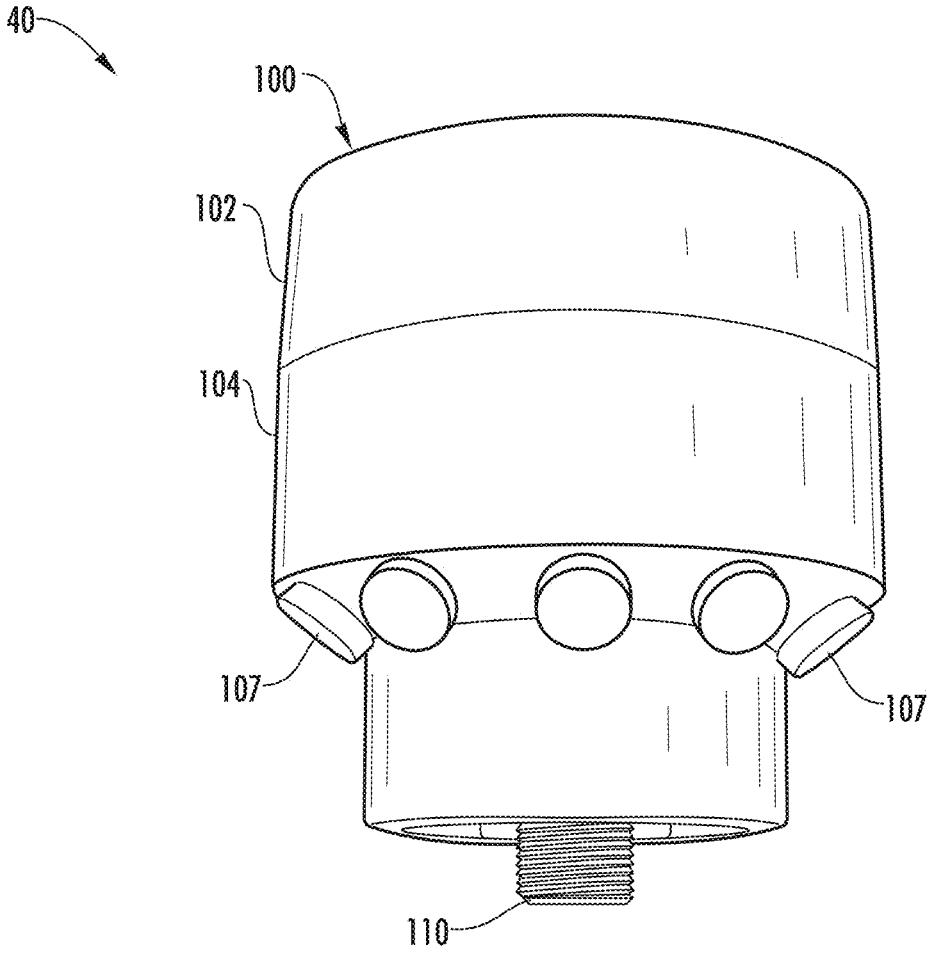
FIG. 3 is a perspective view of a junction hub in accordance with an example embodiment.

As shown in FIGS. 2 and 3, the junction hub 40 may include a fixture body 100 and a connector device 110. The fixture body 100 may provide a housing for some or all of the internal components of the junction hub 40. For example, terminal block 200 and, in some cases, a partition wall 210 (see FIGS. 4-5) may be located inside the fixture body 100. The fixture body 100 may be constructed of metal (e.g., steel), plastic, or any other rigid or semi-rigid material sufficient to house and support the internal components. Moreover, the fixture body 100 may include a top portion 102 operably coupled to a bottom portion 104 of the fixture body 100. In this regard, the top portion 102 of the fixture body 100 may be slidably received over an annular lip of the bottom portion 104 of the fixture body 100. Preferably, the lip may have a reduced outer diameter relative to the adjacent part of bottom portion 104 so that the outer diameters of top portion 102 and bottom portion 104 will be substantially flush as shown when the two portions are coupled together. In some cases, the fixture body 100 may also include a locking device, such as a locking tab or threads, in order to securely retain the top portion 102 with respect to the bottom portion 104.

The bottom portion 104 of the fixture body 100, as shown in FIGS. 2 and 3, may define at least one (and preferably multiple) opening(s) 106 through the bottom portion 104. For example, opening(s) 106 may be formed in a sloped surface that extends annularly around bottom portion 104 as shown. Openings(s) 106 are thus facing generally toward the ground.

The user may pass respective wires of the power source 20 or the lighting fixtures 30 through an opening 106 in order to connect the power source 20 and the lighting fixtures 30 to the terminal block 200 (and thus each other). Each opening 106 may preferably include a removable cap 107. The cap may be removed from the opening 106 when in use and the opening 106 may stay effectively sealed by the cap when not in use. In even further example embodiments, the cap in each opening 106 may be in the form of a flexible grommet having an expandable aperture for passage of wires. Thus, although the cap may or may not be removable, it need not be removed for use. Instead, wiring may enter the junction hub 40 through the expandable aperture. In this case, the grommet will provide an effective barrier to water penetration even when the corresponding hole 106 is in use. The expandable aperture may be formed by a flexible webbing having a weakened portion such as slit that is broken when a wire is initially pushed through it.

The junction hub 40 may also include a connector device 110. The connector device 110 may integrally extend from an exterior surface of the bottom portion 104 of the fixture body 100. In accordance with some example embodiments, a first end of the connector device 110 may be disposed inside the junction hub 40, and the second end of the connector device 110 may be disposed outside of the junction hub 40. In some cases, the connector device 110 may be in the form of an exteriorly threaded boss for operably coupling a mounting structure 300 (see FIGS. 6 and 7) to the fixture body 100. The mounting structure 300 may facilitate the placement of the junction hub 40 in a desired location in the outdoor environment. In some cases, the connector device 110 may define a central opening sealed by a grommet at the first end of the connector device 110. This grommet may have a weakened (e.g., thin) portion that can be easily pushed through for passage of wiring, as described above in relation to caps 107.

Referring again to FIGS. 4 and 5, the inside of top portion 102 of the fixture body 100 can be seen. As shown, terminal block 200 in this embodiment actually comprises two separate terminal blocks referred to as first polarity terminal portion 202 and second polarity terminal portion 204. For example, terminal portion 202 may serve as the positive terminal portion and terminal portion 204 may serve as the ground (or negative) terminal portion, or vice versa. Terminal portions 202 and 204 are in this case separated and supported by a partition wall 210 situated along a diametrical axis of the top portion 102. In this embodiment, wall 210 is integral with the inside of the top portion 102 with the respective terminal portions 202 and 204 being located on opposite sides thereof. In particular, the partition wall 210 depends from an interior surface 220 of the top portion 102 when top portion 102 is positioned on bottom portion 104.

The partition wall 210 may define at least one gap 214 (or other suitable opening) allowing passage of a respective fastener (e.g., a bolt) that connects terminal portions 202 and 204. Tightening of the fastener(s) thus causes firm engagement of terminal portions 202 and 204 with wall 210 to retain terminal portions 202 and 204 in position. The example embodiment illustrated in FIGS. 4 and 5 includes three gaps 214; however, in accordance with other example embodiments contained herein, the partition wall 210 may include more or less than three gaps 214.

As one skilled in the art will appreciate, terminal block 200 enables the electrical connection of several devices located in a landscape lighting system 10 such as power source 20 and one or more of the lighting fixtures 30. Moreover, the terminal block 200 provides a convenient place for troubleshooting problems associated with the landscape lighting system 10. Even further, because the terminal block 200 may serve as a point for connection of the lighting fixtures 30 to the power source 20, voltage received from the power source 20 may be substantially equalized among each of the lighting fixtures 30 connected to the terminal block 200. Additionally, because the terminal block 200 is located in the fixture body 100, the terminal block 200 is protected from weather while the connections made at the terminal block 200 are secure and dry for improved long-term reliability.

Each terminal portion 202 and 204 may have an insulative outer shell defining a plurality of ports 205 and a corresponding clamp 206 (see FIG. 5) for each of the ports 205. A stripped wire end may thus be inserted into a port 205 and retained via movement of the clamp 206. The wire end will then be in galvanic connection with a suitable bus bar that connects all of the ports 205 in that terminal portion. Thus, when the wires of the power source 20 are connected in one of the ports 205 of each of the first terminal portion 202 and second terminal portion 204, the power source 20 will provide power to each lighting fixture 30 also connected to the terminal portions 202 and 204.

In order to connect the power source 20 and the lighting fixtures 30 to the terminal block 200 (i.e., the first and second terminal portions 202 and 204), the wires of the power source 20 and lighting fixture 30 are inserted into respective ports of the first and second terminal portions 202 and 204. For example, the wires of the power source 20 may be inserted by a user into the first set of ports indicated at 208. Accordingly, the positive wire of the power source 20 may be inserted into one of the ports 205 of the first terminal portion 202 (i.e., positive terminal portion), and the negative wire of the power source 20 may be inserted into a corresponding one of the ports 205 of the second terminal portion 204 (i.e., ground terminal portion), such as the first set of ports 208. It should be understood that each of the lighting fixtures 30 may be coupled to the first and second terminal portions 202 and 204 in a similar manner as the power source 20. Accordingly, the wires of a lighting fixture 30 may be inserted by a user into any available set of opposite-polarity ports 205.

As noted above, each port 205 may have a corresponding clamp 206 (see FIG. 5), in this case having a tab by which the user can allow the wire to be inserted into the port. Specifically, the user may depress the tab in this embodiment to insert the wire end into the port 205. Once the wire end has been inserted into the port 205, the user may release the tab (or otherwise move the tab back to its locked position) to ensure a secure connection of the wire with the port 205. Therefore, the lighting fixtures 30 and the power source 20 may be connected to the terminal block 200 in a simple and reliable manner.

In order to provide power to the lighting fixtures 30 of the landscape lighting system 10, the wires of the power source 20 may be passed through one of the openings 106 of the fixture body 100 to connect the wire ends to one of the sets of ports 205 of the terminal block 200. Moreover, the wires of the lighting fixture 30 may also be passed through one of the openings 106 to connect to another open or available set of ports 205. Once the power source 20 and the lighting fixture 30 are all connected to the terminal block 200, power is provided to the lighting fixtures 30. One or more of these wires may alternatively be passed through a central bore of connector device 110.

In this embodiment, each terminal portion 202 and 204 may include eight ports 205. Accordingly, junction hub 40 may enable the connection of up to eight devices (e.g., one power source 20 and up to seven lighting fixtures 30). In other cases, however, each terminal portion 202 and 204 may include more or less than eight ports 205. Thus, the junction hub 40 may enable the connection of more or less than eight devices.

Figure 6:
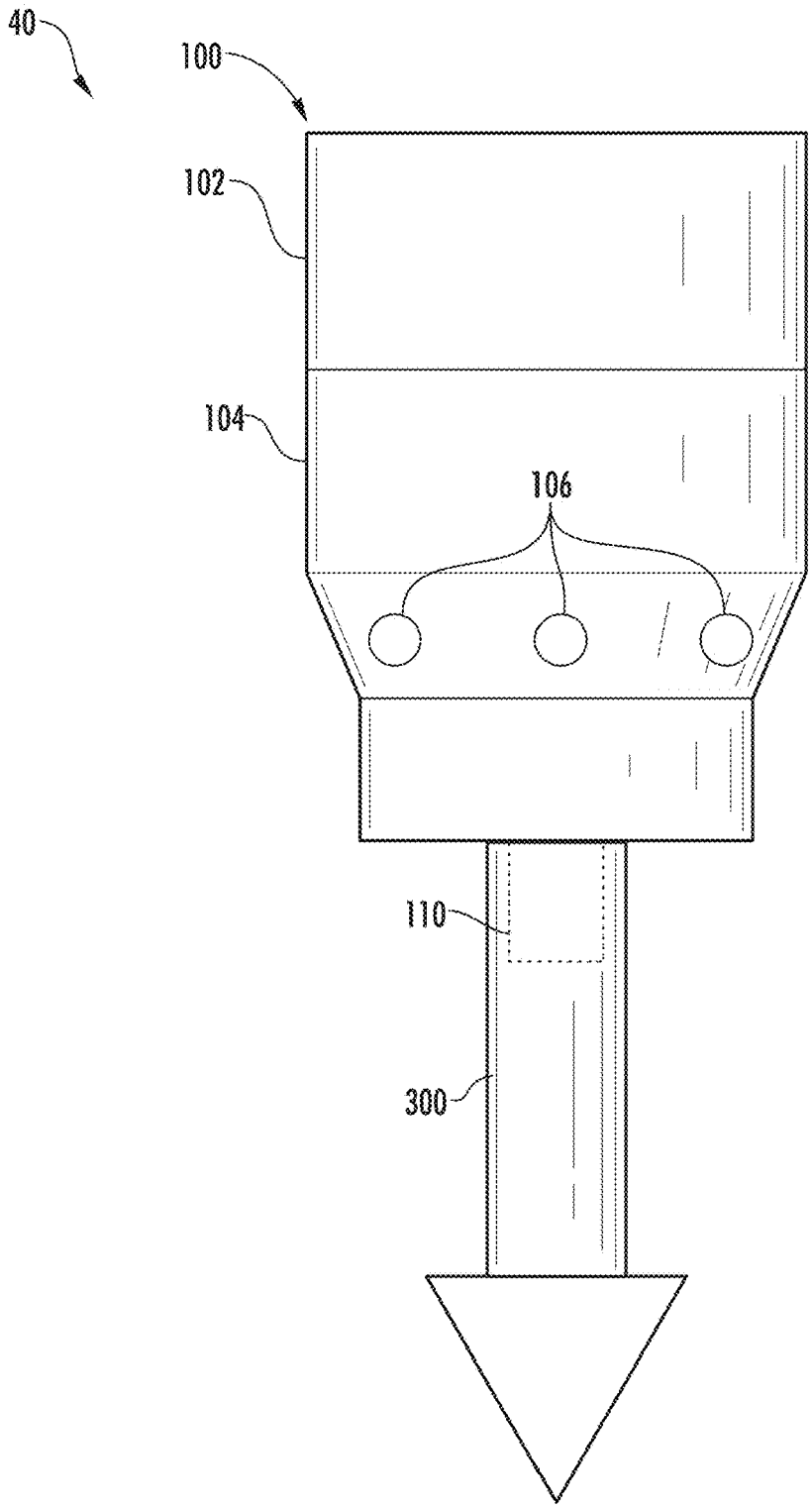
FIG. 6 is a diagrammatic representation of a junction hub with a mounting structure attached thereto in accordance with an example embodiment.
Figure 7:
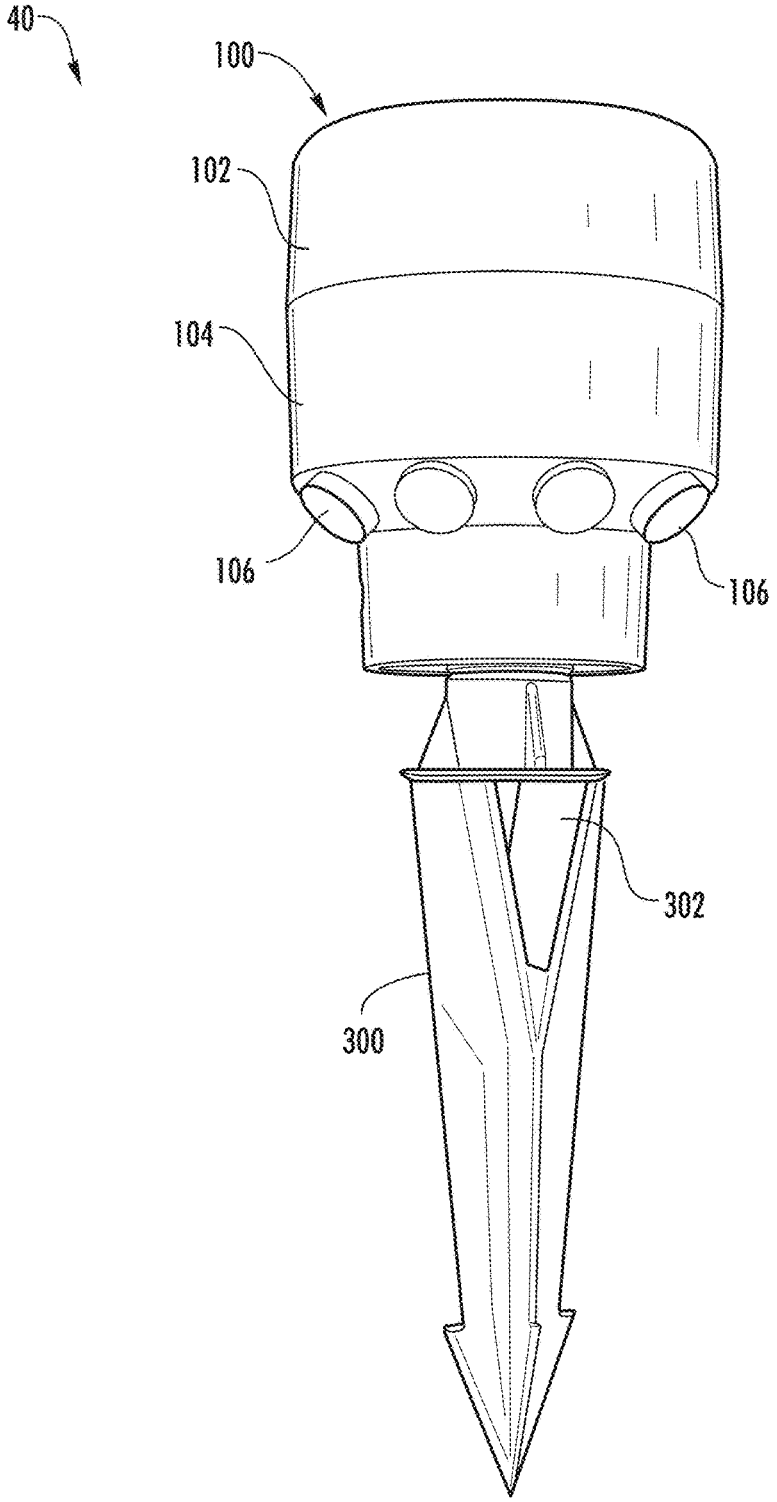
FIG. 7 is a perspective view of a junction hub with a mounting structure attached thereto in accordance with an example embodiment.

FIGS. 6 and 7 illustrate examples of the junction hub 40 having a mounting structure coupled to fixture body 100 in accordance with example embodiments contained herein. As discussed above, a mounting structure 300 may be coupled to the fixture body 100 via the connector device 110. The mounting structure 300 will typically facilitate the placement of the junction hub 40 in a desired location in the outdoor environment. For example, the mounting structure 300 may be in the form of a stake (as shown) that is pushed or otherwise driven into the ground at the desired location. The mounting structure 300 may be constructed of steel, plastic, or any other rigid or semi-rigid material sufficient to support the junction hub 40. As one skilled in the art will appreciate, an opening 302 (FIG. 7) may be provided for passing wires through a hole aligned with connector device 110. In this way, wires can extend into fixture body 100 through connector device 110 when it is in the form of a hollow boss.

Figure 8:
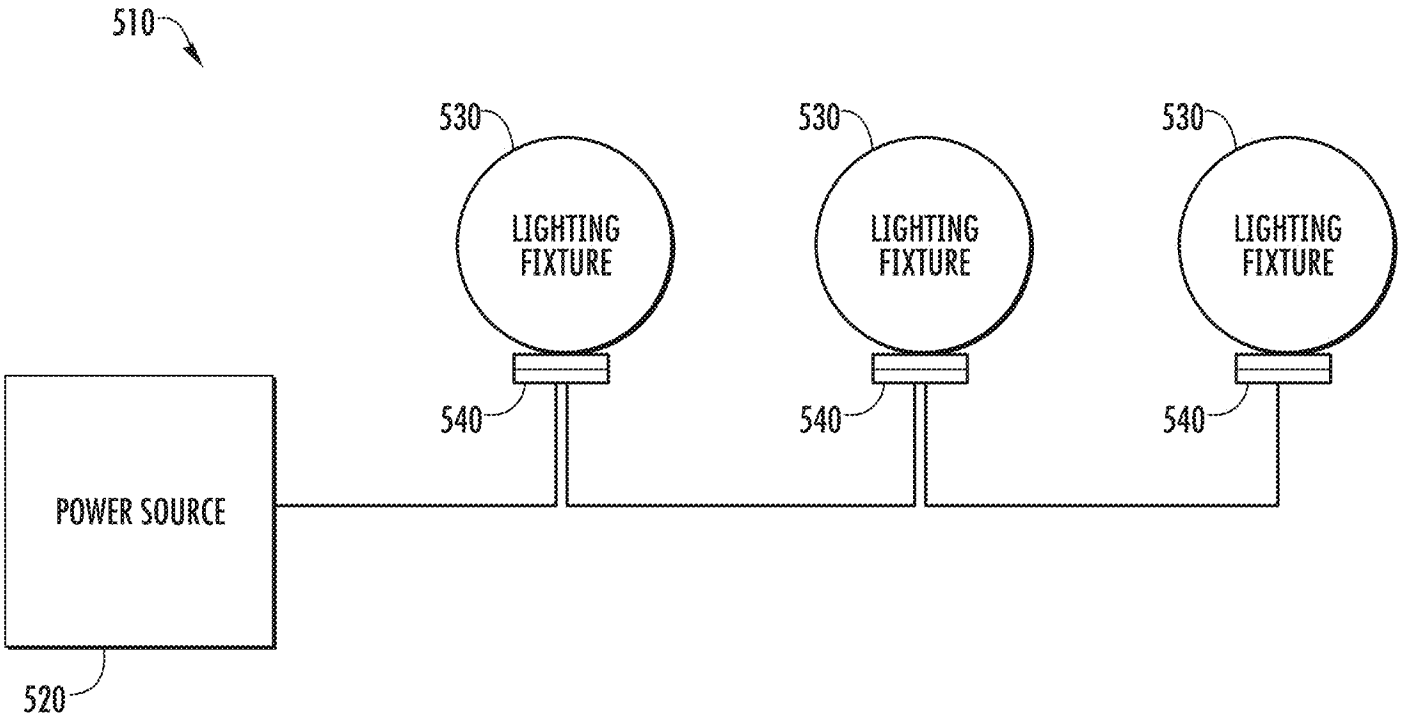
FIG. 8 is a diagrammatic representation of an outdoor lighting system in accordance with another example embodiment.

FIG. 8 illustrates an alternative outdoor landscape lighting system 510 that may be used by itself or in combination one or more junction hubs of the previous embodiment. Lighting system 510 has a power source 520 (which may, for example, be the transformer itself or another junction hub connected to the transformer) and a plurality of lighting fixtures 530. In this case, each lighting fixture 530 has an associated junction hub 540. The lighting fixtures are arranged in daisy chain fashion, with wiring from power source 520 entering the junction hub 540 of the first lighting fixture in the chain. Wiring from this fixture extends to the next fixture in the chain, with still more fixtures (if any) being located farther along the chain. Thus, the various lighting fixtures will be connected to each other in parallel.

Figure 9:
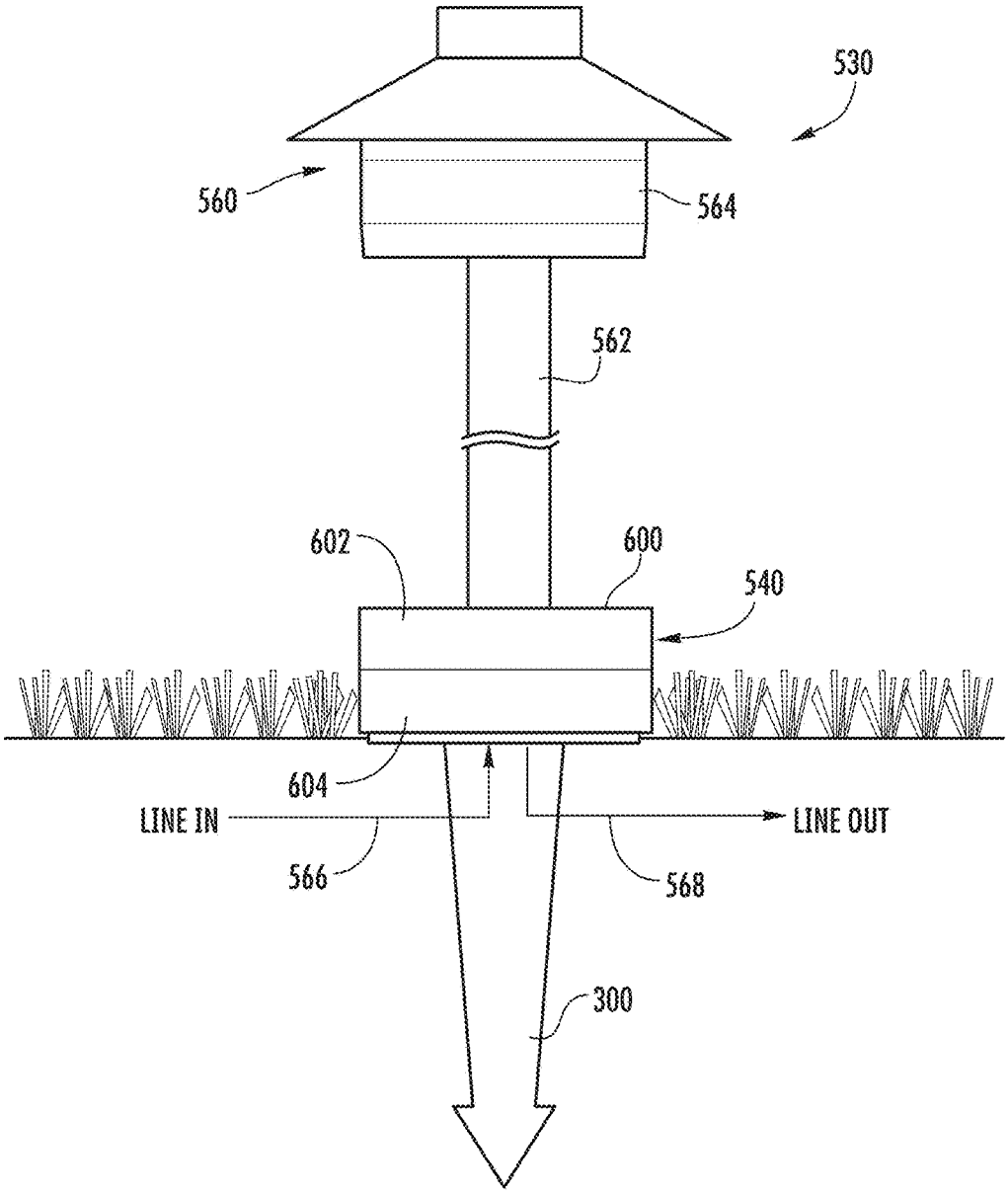
FIG. 9 is a diagrammatic representation of a junction hub and associated lighting fixture in accordance with the embodiment of FIG. 8.

Lighting fixture 530 can be further explained with reference to FIG. 9. A shown, junction hub 540 is located at the top of a mounting structure 300. In this case, mounting structure 300 is in the form of a stake driven into the ground. Junction hub 540 includes a fixture body 600 having first (top) and second (bottom) portions 602 and 604 that are joined together when the junction hub is in use. In this embodiment, lighting fixture 530 includes a lamp portion 560 located at the upper, distal end of a support post 562. The lower, proximal end of post 562 is fixedly connected to junction hub 540 (as will be explained more fully below). While lamp portion 560 may have a variety of specific configurations, the illustrated embodiment has a translucent window 564 through which light from the lighting source contained therein may be emitted.

Figure 10:
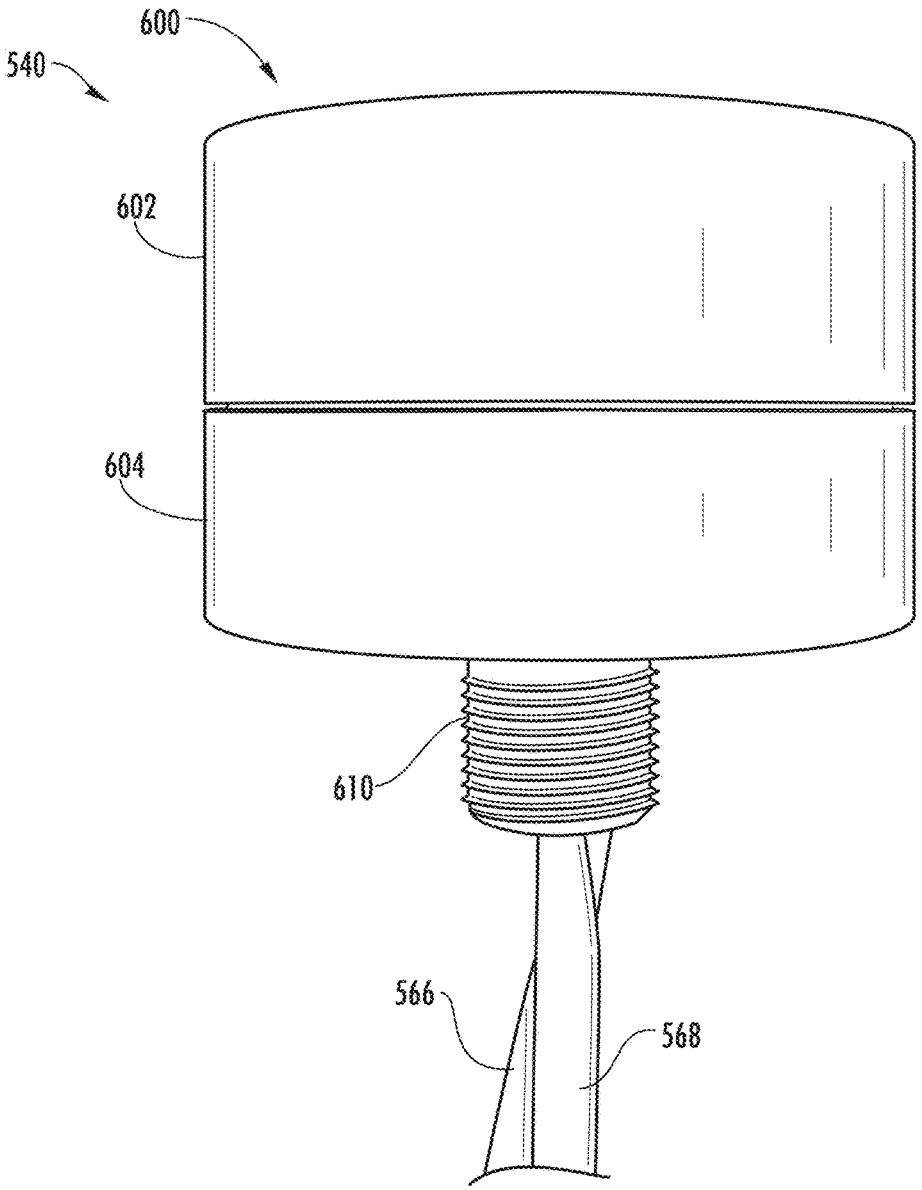
FIG. 10 is a perspective view of a junction hub in accordance with the embodiment of FIG. 8.

Certain additional details regarding fixture body 600 can be most easily explained with reference to FIGS. 10 and 11. As shown, second portion 604 of fixture body 600 includes a connector device 610 (here in the form of a threaded boss) for attachment to the mounting structure 300. In this embodiment, wiring 566 entering fixture body 600 and wiring 568 exiting fixture body 600 pass through the central bore defined by connector device 610. Electrical connections to the associated lighting fixtures 30 are made inside of fixture body 600.

Figure 11:
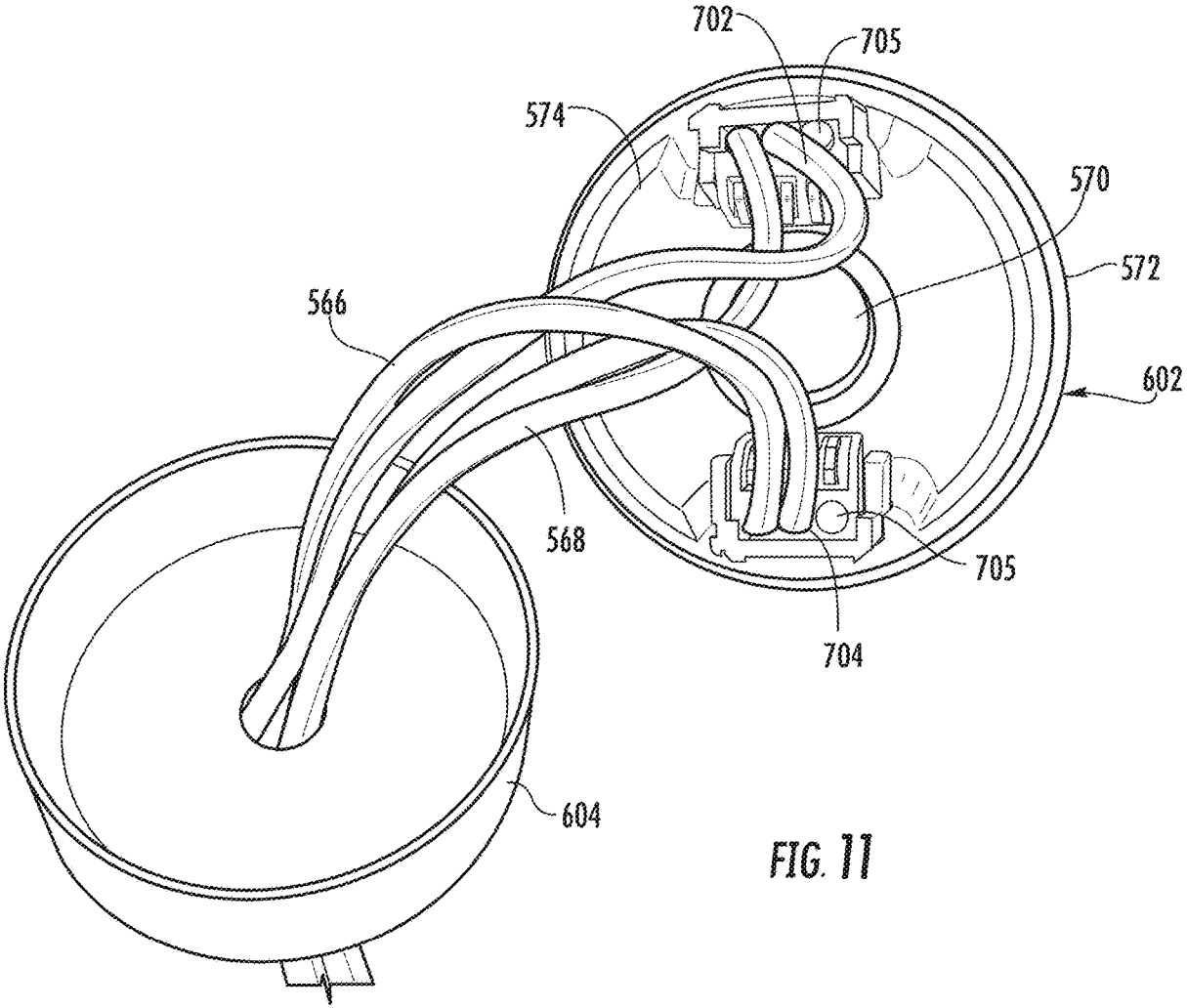
FIG. 11 is a perspective view of the junction hub of FIG. 10 with top and bottom portions separated to show the interior thereof.

FIG. 11 shows portions 602 and 604 of fixture body 600 separated for making electrical connections. As described above, wiring 566 and 568 passes into second portion 604 through connector device 610. In this embodiment, first and second polarity terminal portions 702 and 704 are located on the underside of first portion 602 of the fixture body. Each terminal portion 702 and 704 has a total of three ports 705 into which is inserted a stripped wire end—one port for each polarity incoming wire, one port for each polarity outgoing wire, and one port for each polarity wire from the associated lighting fixture 530. Once the stripped wire end is inserted, a clamping lever is moved to the closed position to lock and retain the wire in position. As one skilled in the art will understand, all wires connected to each of the terminal portions will thus be connected together in parallel. In a preferred embodiment, each of the terminal portions 702 and 704 may comprise a WAGO 222 3-conductor terminal block sold by Wago Corporation of Germantown, Wis.

Terminal portions 702 and 704 are diametrically opposed on opposite sides of a central opening 570 defined in first portion 602 of fixture body 600. As will be explained more fully below, central opening 570 is formed by a depending boss that defines internal threads. Central opening 570 thus allows attachment of the support post 562 of lighting fixture 530, which defines exterior threads on its lower, proximal end. In other words, the support post is attached to fixture body 600 of junction hub 540 in the same manner that it would otherwise be attached directly to stake 300. Wiring for the lighting fixture 530 enters fixture body 600 through central opening 570.

The exterior of fixture body 600 may advantageously be formed of an aesthetically pleasing material, such as brass, and has a relatively small height, to complement the appearance of the lighting fixture 530. For example, the disc-shaped configuration of fixture body 600 may resemble a brass stake-cover as are sometimes used to conceal the plastic material from which outdoor lighting stakes are frequently made. Regardless of aesthetic concerns, the exterior of fixture body 600 is preferably sufficiently durable that it will not be damaged by common landscaping equipment such as string trimmers. In addition, it will often be desirable to attach the stake to junction hub 540 and hammer the combination into the ground prior to attaching support post 562. This avoids wires twisting inside the fixture body 600.

Junction hub 540 permits all electrical connections for lighting fixture 530 to be made above ground. In some embodiments, junction hub 540 may be provided separately from the lighting fixture (e.g., as a retrofit) to improve and simplify the lighting connections. In other cases, junction hub 540 may be provided as part of the lighting fixture 530 when sold. In the latter case, lighting fixture 530 need not have a wiring "tail" since the internal wiring only needs to be long enough to reach terminal portions 702 and 704. At the time of installation, an installer then brings field wiring into the junction hub 540 for connection to the fixture wiring using terminal portions 702 and 704.

First portion 602 and second portion 604 may be slidably connected together to close fixture body 600, or they may be connected together via threads. Referring now to FIGS. 12A-14, fixture body 600 comprises three separate pieces in the illustrated embodiment. Specifically, first portion 602 comprises an outer shell 572 (FIGS. 13A and 13B) and an insert 574 (FIG. 14) received in outer shell 572, which along with second portion 604 comprises the three pieces. Outer shell 572 and second portion 604 may be made of a more durable and/or aesthetic pleasing material, such as brass. Insert 574 may be made of a suitable polymeric material and attached to outer shell 572 by press fit or a suitable adhesive.

Figure 12A:
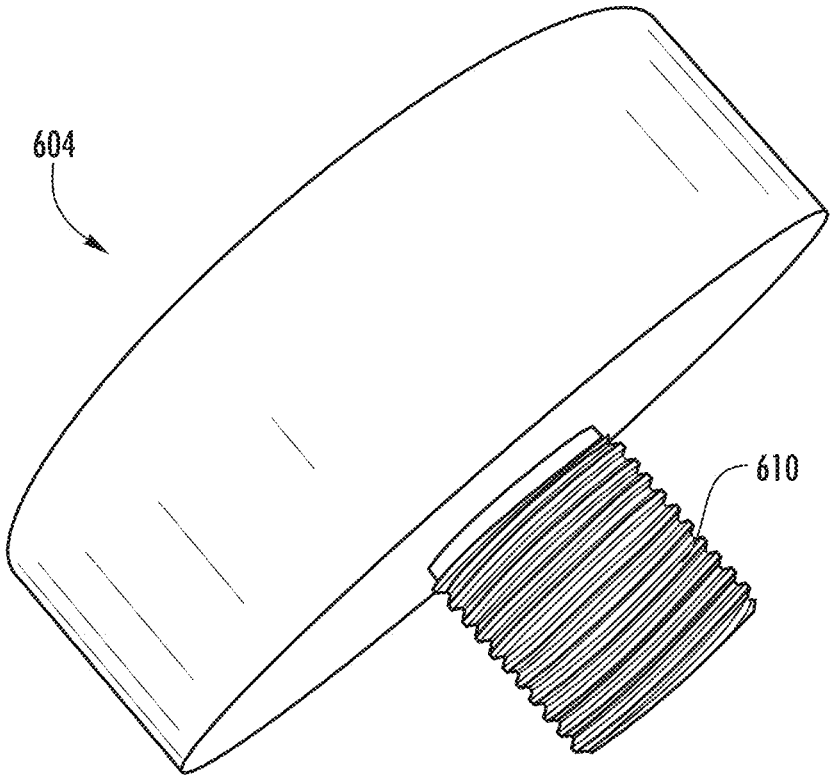
FIG. 12A is a perspective exterior view of a bottom portion of the junction hub of FIG. 8 showing the integral connector device thereof.
Figure 12B:
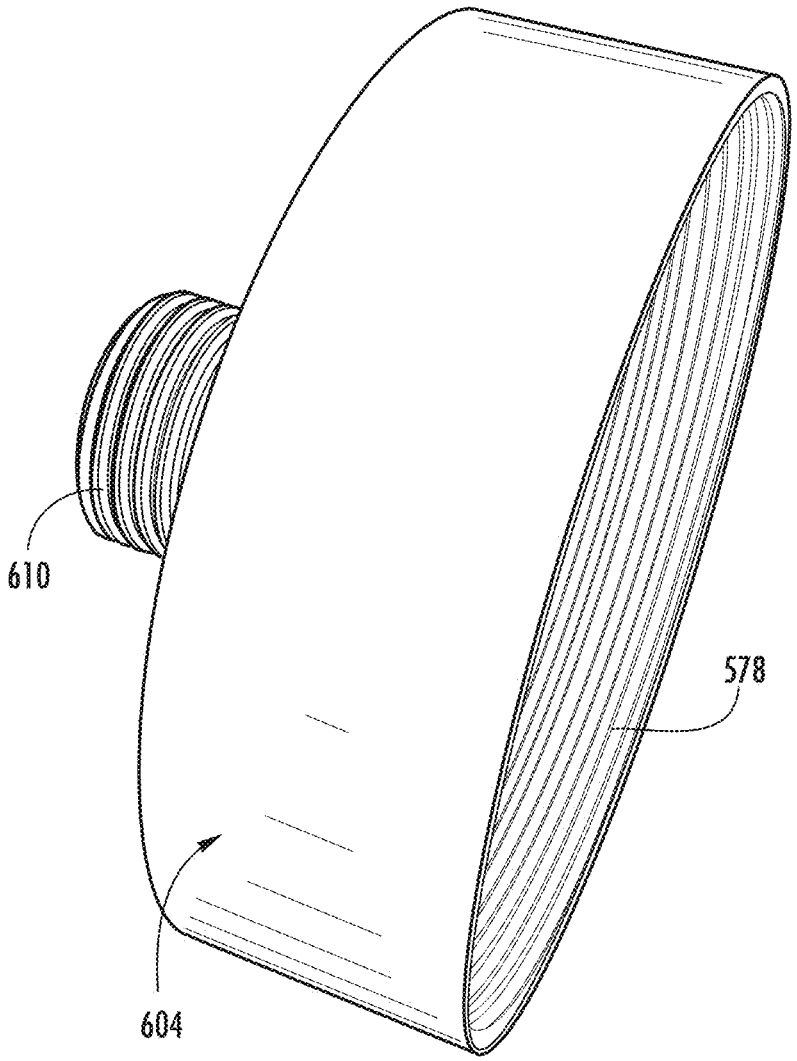
FIG. 12B is a perspective exterior view of the bottom portion of the junction hub of FIG. 8 showing the integral connector device thereof.
Figure 13A:
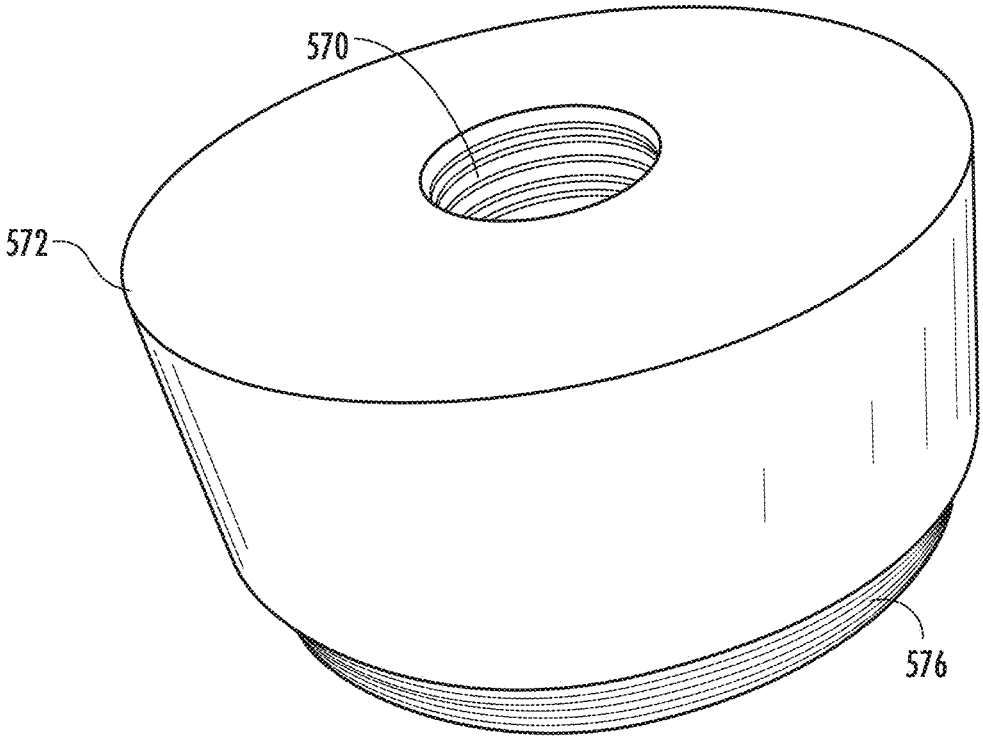
FIG. 13A is a perspective exterior view of the top portion of the junction hub of FIG. 8 showing a threaded opening defined therein for connection of a lighting fixture support post.
Figure 13B:
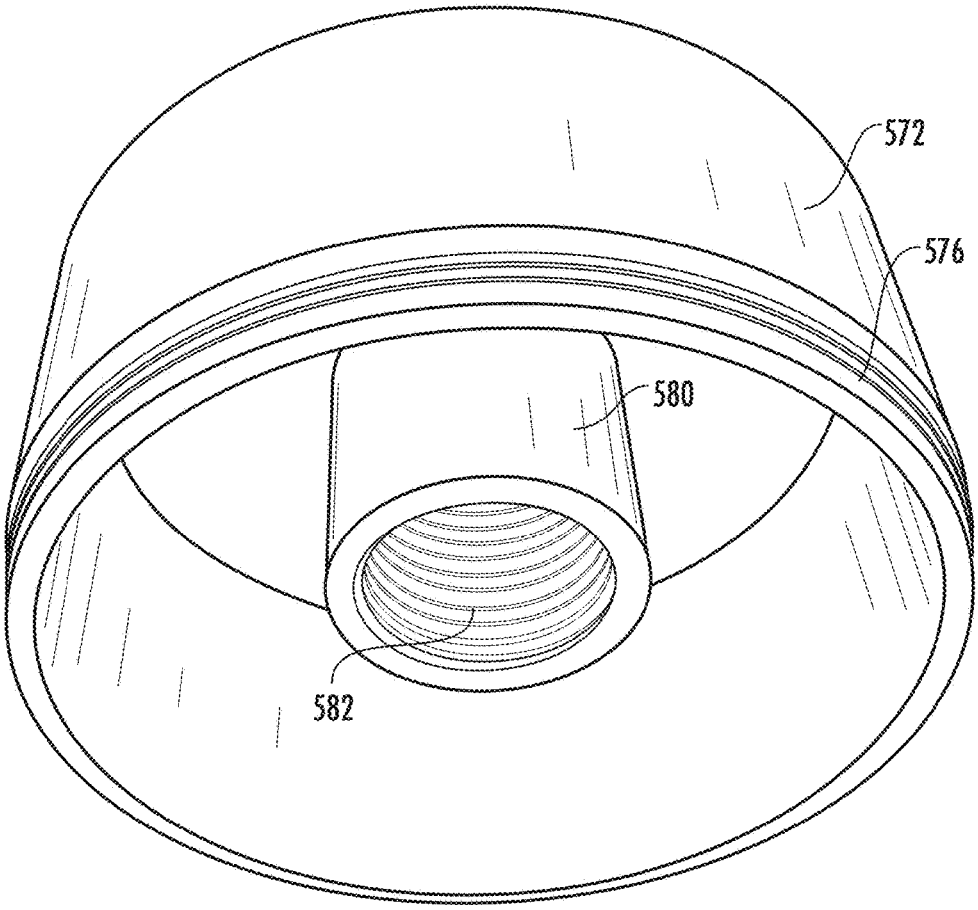
FIG. 13B is a perspective interior view of the top portion of the junction hub of FIG. 8 showing an internal boss defining the threaded opening therein for connection of a lighting fixture support post.

Referring now specifically to FIGS. 13A and 13B, outer shell 572 is shown. As can be seen, this embodiment utilizes external threads 576 which engage internal threads 578 of second portion 604 (FIG. 12B). Threads 576 may have a reduced outer diameter relative to the adjacent part of outer shell 572 so that outer shell 572 and second portion 604 are substantially flush when connected together. Preferably, a suitable gasket may be located at the interface between outer shell 572 and second portion 604 to inhibit water penetration. Boss 580 defines inner threads 582 for attachment of the support post 562 as discussed above.

Figure 14:
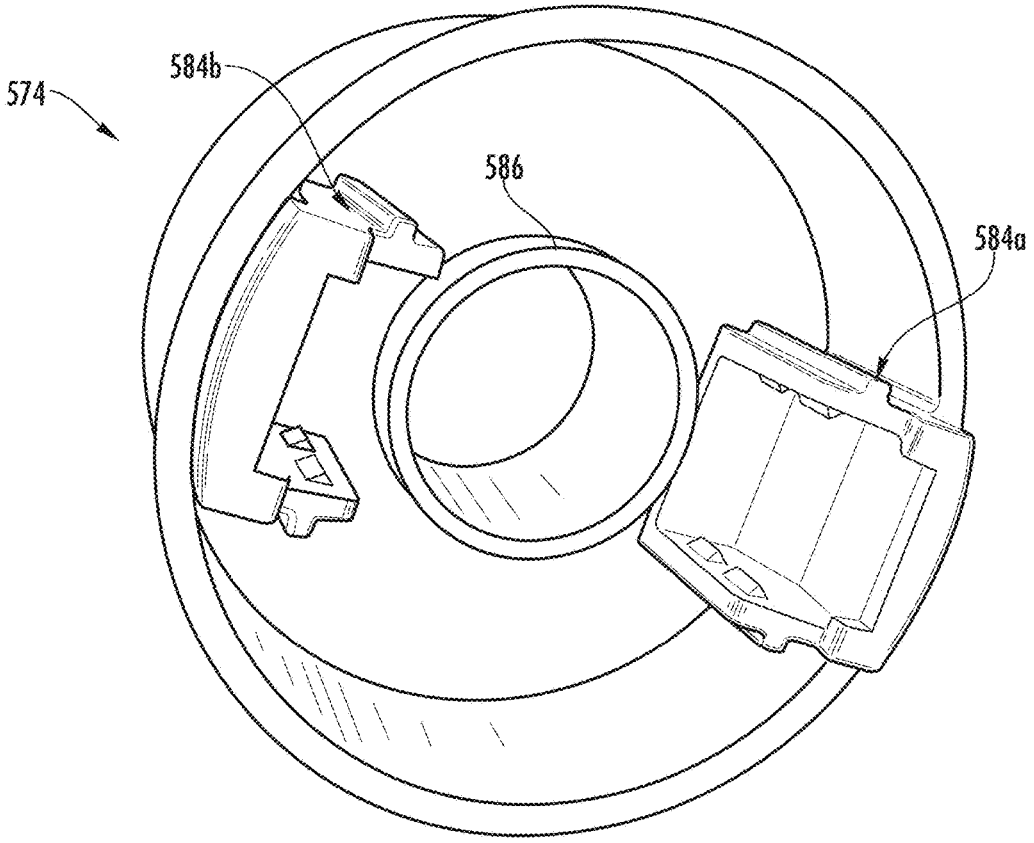
FIG. 14 is a perspective view showing the interior of an insert piece which may be fit into the top portion of the junction hub of FIG. 8.

Insert 574 is most easily described with reference to FIG. 14. As shown, insert 574 may define one or more receptacles into which a respective terminal block may be received. In this case, for example, a pair of diametrically-opposed receptacles 584*a* and 584*b* are provided for receipt of respective terminal portions 702 and 704. In some embodiments, terminal portions 702 and 704 may be adequately retained by press fit, although adhesive may also be used to retain terminal portions 702 and 704 in their associated receptacle. In this embodiment, insert 574 includes a centering boss 586 which is slidably received around boss 580 of outer shell 572.

It can thus be seen that the present invention provides various embodiments of a novel landscape lighting junction hub. Many modifications and other embodiments of the invention set forth herein will come to mind to one skilled in the art to which the invention pertains having the benefit of the teachings presented in the foregoing descriptions and the associated drawings. For example, some embodiments are contemplated in which wires are connected directed together inside the junction hub, such as by using conventional wire nuts, rather than having a terminal block. Therefore, it is to be understood that the invention is not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required, or essential to all embodiments or to that which is claimed herein. Although specific terms are employed herein, they are used in a generic and descriptive sense only and not for purposes of limitation.

What is claimed is:

1. An outdoor landscape lighting junction hub, said junction hub comprising:

a fixture body having a top portion and a bottom portion removably connectable together to define an interior;

a connector device for operably coupling a mounting structure to the fixture body, the connector device being in the form of a depending boss defining exterior threads thereon and integrally extending from the bottom portion of the fixture body;

a terminal block disposed in the interior of the fixture body for facilitating the connection of a power source to at least two lighting fixtures; and wherein the bottom portion of the fixture body defines a plurality of openings for receiving wires of the power source or the at least two lighting fixtures.

2. The outdoor landscape lighting junction hub of claim 1, wherein the terminal block is connected to the top portion of the fixture body.

3. The outdoor landscape lighting junction hub of claim 1, further comprising a respective removable cap situated in at least one of the plurality of openings to seal the respective opening when not in use.

4. The outdoor landscape lighting junction hub of claim 1, wherein said depending boss is hollow to allow passage of wires therethrough.

5. The outdoor landscape lighting junction hub of claim 1, wherein the terminal block comprises a first polarity terminal portion and a second polarity terminal portion, wherein the first polarity terminal portion is disposed on a first side of a partition wall and the second polarity terminal portion is disposed on a second side of the partition wall.

6. The outdoor landscape lighting junction hub of claim 5, wherein the partition wall comprises at least one opening receiving a fastener that operably couples the first polarity terminal portion to the second polarity terminal portion.

7. The outdoor landscape lighting junction hub of claim 1, wherein the top portion and the bottom portion are slidably connected.

8. The outdoor landscape lighting junction hub of claim 1, wherein the top portion and the bottom portion are threadably connected.

9. The outdoor landscape lighting junction hub of claim 1, wherein the terminal block comprises a plurality of ports and a respective locking mechanism corresponding to each of said ports to releasably retain a respective wire therein.

10. An outdoor landscape lighting system comprising:

a power source;

a plurality of lighting fixtures; and at least one junction hub having:

a fixture body comprising a top portion and a bottom portion defining an interior;

a mounting structure coupled to the fixture body, said mounting structure in the form of a stake configured to be inserted into the ground; and a terminal block disposed in the interior of the fixture body electrically connecting the power source to all of the plurality of lighting fixtures.

11. The outdoor landscape lighting system of claim 10, wherein the terminal block is connected to the top portion of the fixture body.

12. The outdoor landscape lighting system of claim 10, wherein the bottom portion of the fixture body defines a plurality of spaced-apart openings for receiving wires of the power source or the plurality of lighting fixtures.

13. The outdoor landscape lighting system of claim 12, further comprising a respective removable cap situated in at least one of the plurality of openings to seal the respective opening when not in use.

14. The outdoor landscape lighting system of claim 10, comprising a connector device that integrally extends from the bottom portion of the fixture body for coupling the mounting structure.

15. The outdoor landscape lighting system of claim 10, wherein terminal block comprises a first polarity terminal portion and a second polarity terminal portion.

16. The outdoor landscape lighting system of claim 15, wherein the first polarity terminal portion is disposed on a first side of a partition wall and the second polarity terminal portion is disposed on a second side of the partition wall.

17. The outdoor landscape lighting system of claim 16, wherein the partition wall comprises at least one opening receiving a fastener that operably couples the first polarity terminal portion to the second polarity terminal portion of the terminal block.

18. The outdoor landscape lighting system of claim 15, wherein the first polarity terminal portion and the second polarity terminal portion are disposed in respective diametrically opposed receptacles.

19. The outdoor landscape lighting system of claim 10, wherein the top portion defines an opening having internal threads for connecting a lighting fixture support post.

20. The outdoor landscape lighting system of claim 10, wherein the terminal block comprises a plurality of ports and a respective locking mechanism corresponding to each of said ports to releasably retain a respective wire therein.

* * * * *